United States Patent [19]

Van Hoomissen et al.

[11] Patent Number: 4,640,496

[45] Date of Patent: Feb. 3, 1987

[54] DUMP BLOCK FOR DRAGLINE BUCKET

[75] Inventors: Robert L. Van Hoomissen; Terry L. Briscoe; Don P. S. Barker, all of Portland, Oreg.

[73] Assignee: ESCO Corporation, Portland, Oreg.

[21] Appl. No.: 720,301

[22] Filed: Apr. 4, 1985

[51] Int. Cl.[4] ..... B66D 3/04

[52] U.S. Cl. ..... 254/415; 254/416

[58] Field of Search ..... 254/390, 393, 402, 403, 254/404, 405, 406, 412, 416, 415, 901, 902; 384/273, 272, 281, 295, 301, 417, 418, 507, 508

[56] References Cited

U.S. PATENT DOCUMENTS

| | | | |
|---|---|---|---|
| 1,010,018 | 11/1911 | Christensen | 254/405 |
| 2,197,698 | 4/1940 | Lamberth | 254/405 |
| 2,635,015 | 4/1953 | Babb | 384/273 X |
| 2,806,380 | 9/1957 | Martin | 254/406 X |
| 2,814,890 | 12/1957 | Mutti | 254/415 X |
| 3,010,700 | 11/1961 | Petersen | 254/902 X |
| 3,337,188 | 8/1967 | Manson | 254/412 |
| 3,762,240 | 10/1973 | Adams | 384/272 X |

FOREIGN PATENT DOCUMENTS

| | | | |
|---|---|---|---|
| 464410 | 4/1950 | Canada | 254/390 |
| 3312522 | 10/1983 | Fed. Rep. of Germany | 254/390 |
| 962174 | 9/1982 | U.S.S.R. | 254/417 |

*Primary Examiner*—Stuart S. Levy
*Assistant Examiner*—Joseph J. Hail, III
*Attorney, Agent, or Firm*—Tilton, Fallon, Lungmus & Chestnut

[57] ABSTRACT

A dump block is provided for a dragline bucket wherein a central cylinder is equipped with axially spaced side plates to provide a reeve-way for the dump rope, and a steel ring rotatably disposed about the cylinder having inner and outer plastic elements with the cylinder providing an oil reservoir for lubricating the inner plastic elements.

21 Claims, 4 Drawing Figures

DUMP BLOCK FOR DRAGLINE BUCKET

BACKGROUND AND SUMMARY OF INVENTION

This invention relates to a dump block for a dragline bucket and, more particularly, to a dump block featuring novel and advantageous plastic journals.

The dump block is provided as part of the rigging of a dragline and is employed in lifting and carrying the bucket, then allowing the bucket to dump when the drag chains are slacked. The dump block has reeved or threaded therein a rope (generally heavy-duty wire rope) and this rope normally wears out on the order of 2–4 weeks of operation. This short life span causes increased costs for the dragline operators, viz., mines, etc. in two areas: (1) the cost of the rope can be quite expensive if the operators are not able to use the worn drag or hoist rope and (2) there is the cost of down-time associated with changing the ropes this frequently.

For a sizable bucket, the normal dump block can be approximately 48" in diameter which has a pin at the center of approximately 5" diameter. The pin normally carries a tapered roller bearing which is not only extremely expensive because of the highly machined parts but also wears out quickly and is an area of high maintenance. To operate the conventional dump block, the tapered roller bearings should be continually checked and tightened to insure proper preload on the bearings. When this is not done, the bearing fails prematurely.

According to the invention, a dump block is provided which has a sizable increase in bearing surface thereby reducing the wear and loads on the bearing. To achieve this, and simultaneously achieve the goal of easy maintenance, a significantly larger center pin is provided in the form of a hollow pipe which doubles as an oil reservoir. By reducing the loads on the bearing, we are able to employ plastic journals and most advantageously in the form of arcuate segments disposed inwardly and outwardly of a steel annulus.

A number of advantages accrue from the invention which include: (1) reduction of the weight of the entire dump block assembly to enable the machine to carry more dirt, or to allow for the addition of more weight at a wear area on the bucket; (2) increase of the dump rope life by the addition of plastic rope groove segments so that the rope wear life can be much as doubled or tripled; (3) increase of the life of the bearing through the use of plastic bearing inserts which require low maintenance and are inexpensive to replace; (4) the addition of an oil reservoir for continual oiling of the plastic bearings to reduce friction; and (5) reduction of the downtime by making all of these parts quick and easy to change and replace. All of the foregoing advantages contribute to a reduction in the overall cost of the dump block and, more importantly, the operation of the overall machine.

Other objects and advantages of the invention may be seen in the details of the ensuing specification.

The invention is described in conjunction with an illustrative embodiment in the accompanying drawing, in which FIG. 1 is a side elevational view of a dragline bucket of conventional design and wherein the rigging is depicted fragmentarily;

DETAILED DESCRIPTION

Figure 1:
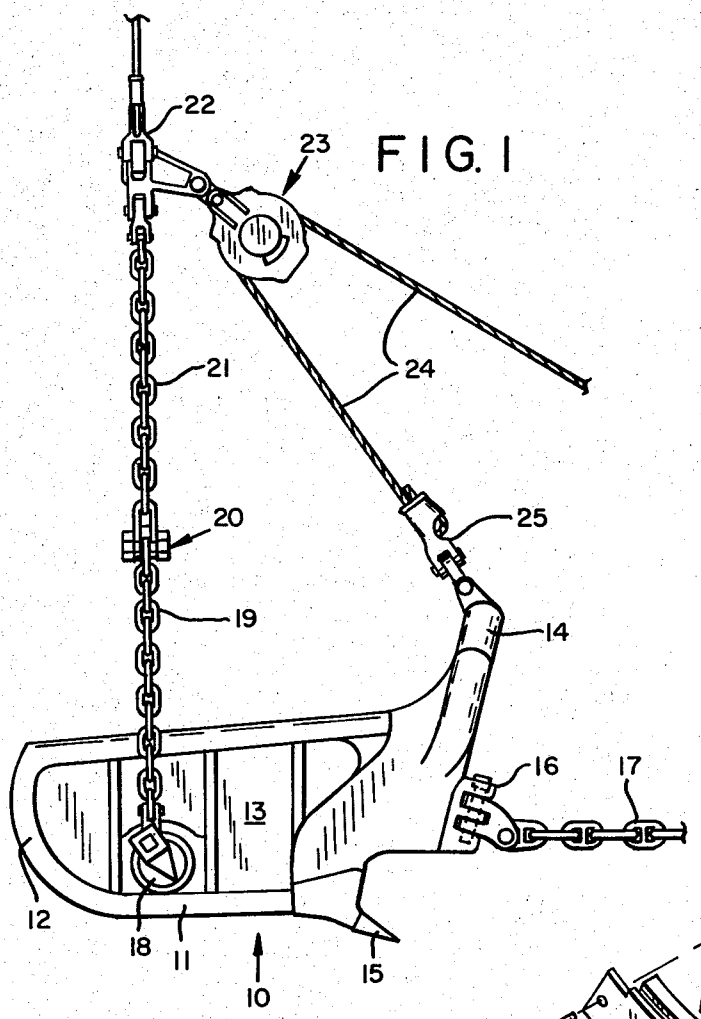

In the illustration given and with reference first to FIG. 1, the numeral 10 designates generally a dragline bucket constructed of a bottom wall 11 merging into a rear wall 12 and closed at the sides thereof by sidewalls 13. At the forward end the bucket 10 is equipped with an arch 14 and the bottom wall 11 at its forward end is equipped with a plurality of excavating teeth 15.

At the forward end of the sidewalls 13 hitch plate assemblies 16 are provided for the connection of the two drag chains 17.

Each sidewall 13 is equipped with a trunnion mounting 18 for the securement of a lower hoist chain 19. Extending between the two hoist chains 19 is a spreader bar assembly 20 to which is connected the upper hoist chains 21. These are connected to a hoist socket 22 which in turn carries the inventive dump block generally designated 23.

The dump block 23 has reeved or threaded therein the dump rope 24 which at one end is connected by means of an anchor bracket 25 to the arch 14. All of the foregoing rigging is generally conventional to perform the functions of dragging, hoisting and dumping.

Dump Block Assembly

Figure 2:
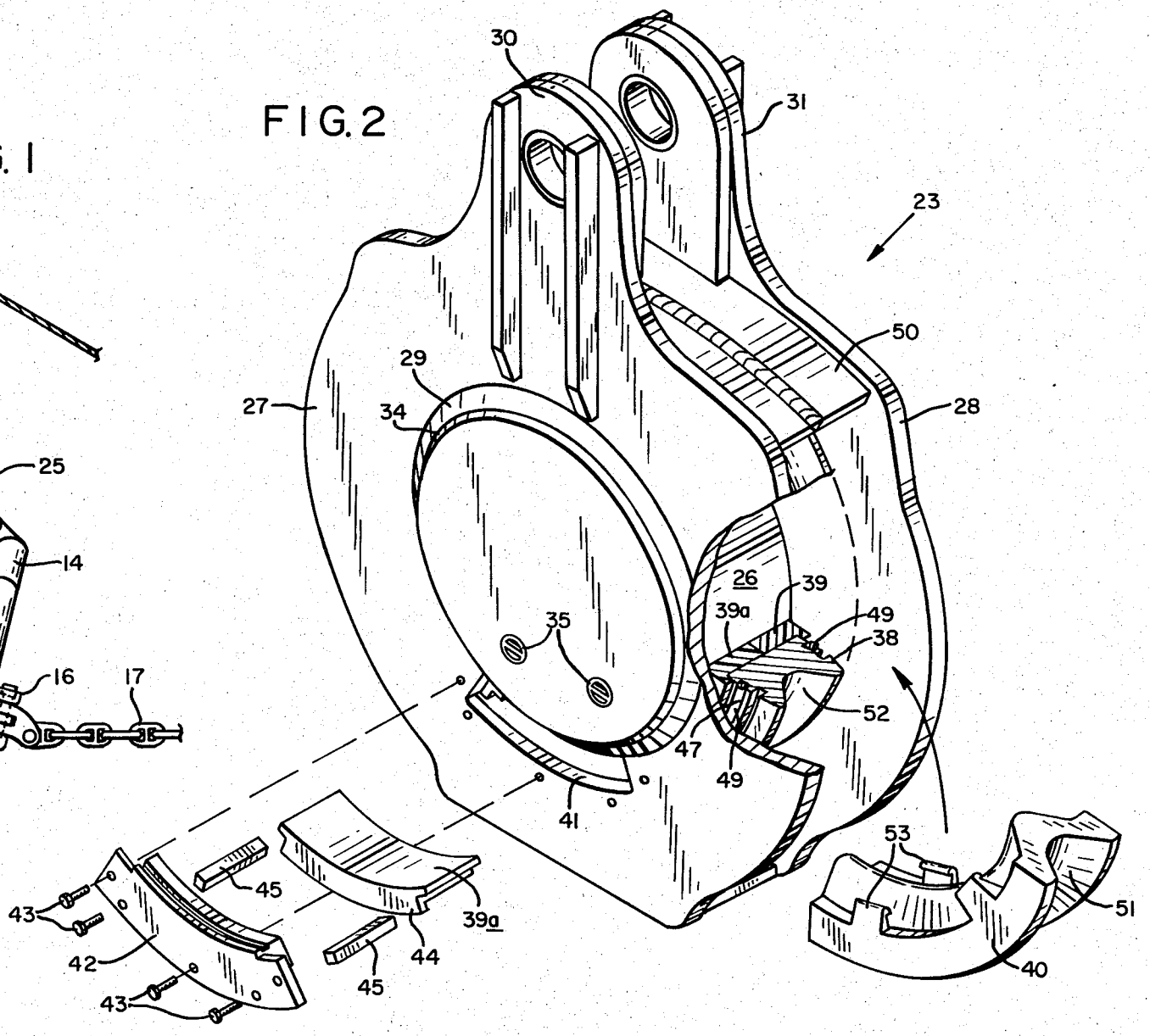
FIG. 2 is an exploded perspective view of a dump block, partially in section, and featuring details of the instant invention.

The dump block assembly can be quickly appreciated first from a consideration of FIG. 2. The dump block assembly or body includes the previously mentioned pipe or cylinder 26—see the central right hand portion of FIG. 2. Weldably secured thereto in axially spaced relation are a pair of confining plates 27 and 28. The illustrative method of construction can be also seen readily from a consideration of FIG. 4 where the weldments for the plates 27 and 28 to the pipe 26 are designated by the numeral 29.

The confining plates 27, 28 can be considered generally circular in side elevation, viz., the 48" diameter dimension given above applying. However, one portion of the confining plates 27, 28 is extended in the form of integral lugs 30 and 31 to provide a swivel mount.

Figure 3:
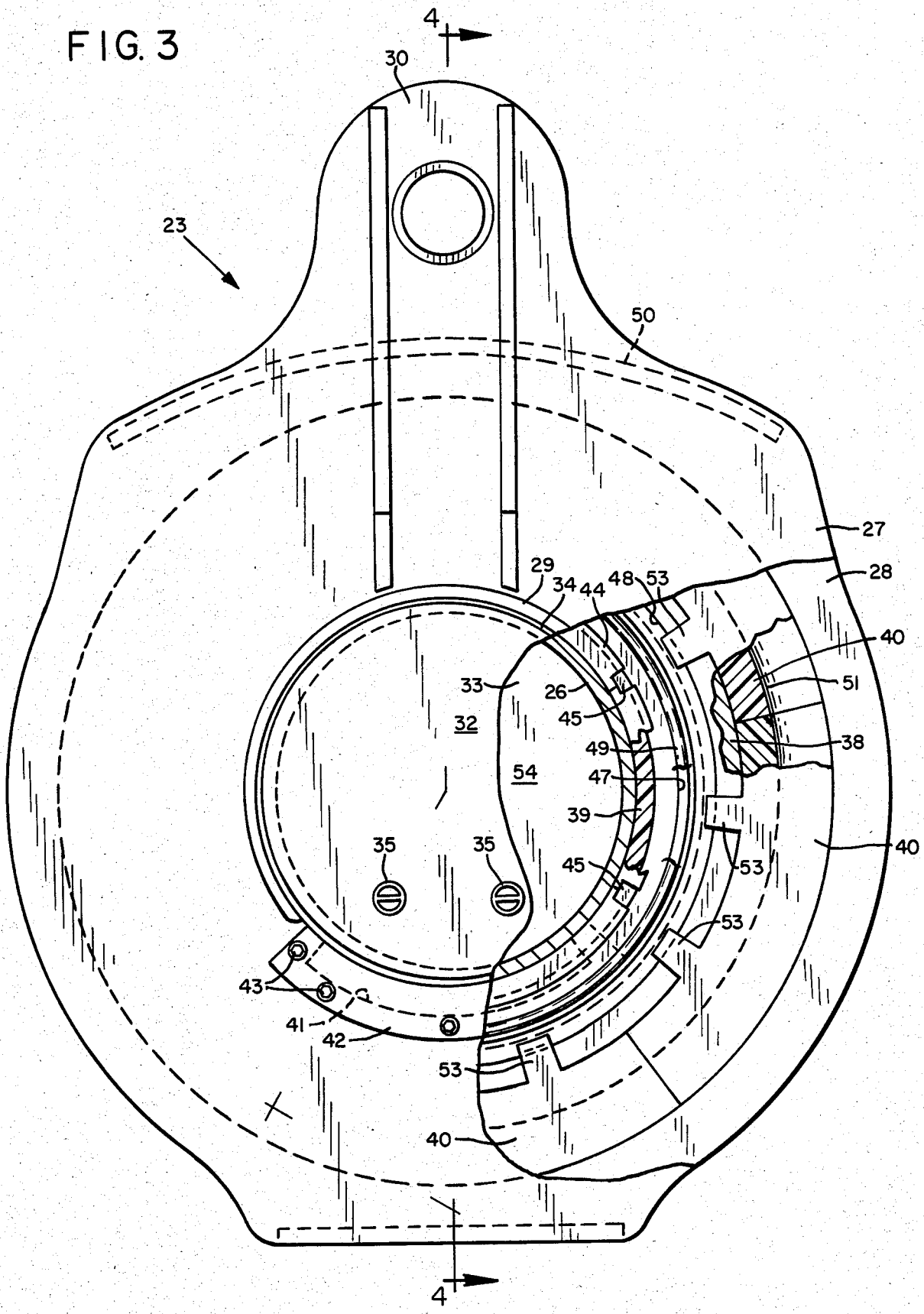
FIG. 3 is a side elevational view of the inventive dump block, partially broken away to show parts thereof in section.
Figure 4:
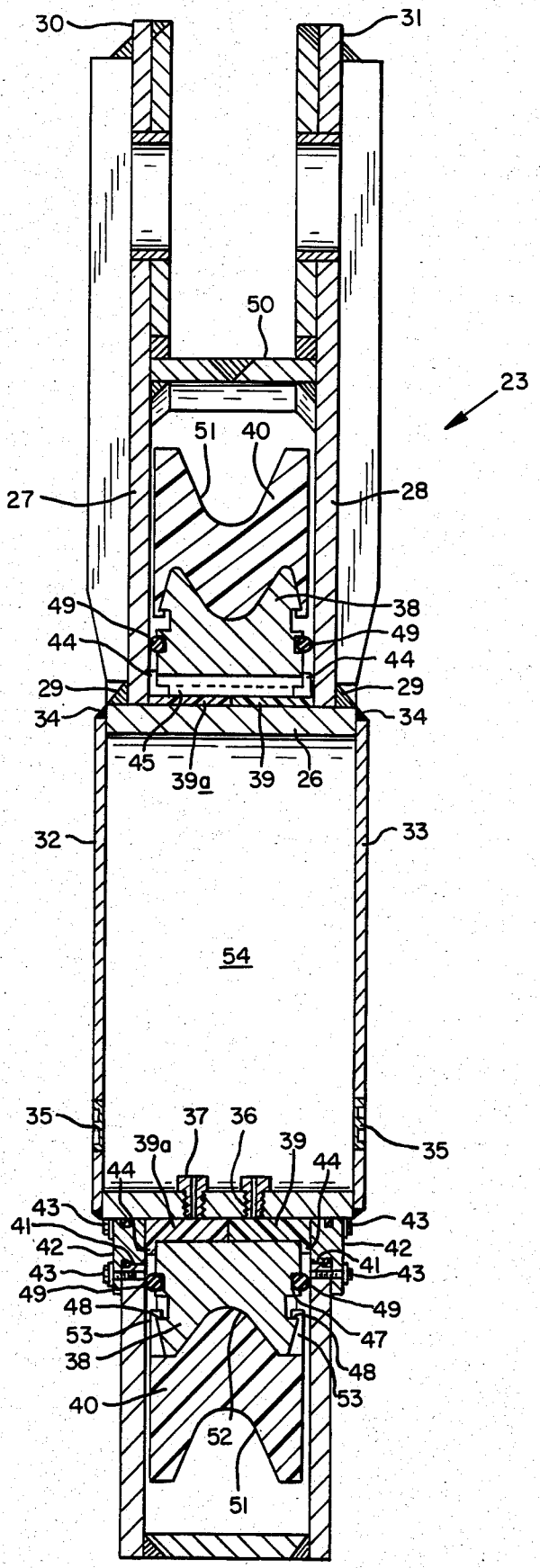
FIG. 4 is a diametral sectional view of the dump block taken along the sight line 4—4 applied to FIG. 3.

Referring now to FIG. 4, it will be seen that the central pipe 26 has closure means in the form of covers 32 and 33 weldably secured as the ends thereof as by welds 34. As seen in FIG. 3, access openings are provided in the covers 32 and 33 as at 35. These can be used for filling and draining the reservoir and are aligned with port means 36—see FIG. 4—for providing lubrication to the bearing equipped ring 38. To develop proper lubrication, threaded fittings 37, each equipped with an axial passage, are installed in the port means 36. These are in alignment with each of the access openings 35 for convenience of change.

Plastic Journals

According to the invention, plastic journals are provided on the inside and outside of a steel ring or annulus 38 (compare FIGS. 2 and 4). This annulus 38 with its inner and outer plastic members rotates freely about the fixed pipe 26—and advantageously the fixed pipe 26 has a machined outer wall for this purpose. The annulus 38 is equipped with segmental inner and outer plastic arcuate elements 39 and 40, each of which will now be described in detail.

Inner Bearing Segments

On the outer diameter of the pipe 26 ride the plastic bearing elements 39 shown in FIGS. 2 and 4. These bearing inserts are installed by way of an access opening 41 in each of the confining walls 27, 28. As can be readily appreciated from a consideration of FIG. 2, the inner bearing elements or segments are arranged in side-by-side, i.e., axially aligned, pairs.

After all of the inner plastic bearing elements 39 have been installed, the access openings 41 are closed by means of an oil-seal equipped cover plate 42 through the use of suitable screws 43.

In the illustration given, we employ six pairs of arcuate inner bearing elements as at 39*a* in the lower left hand portion of FIG. 2. Thus, each element has an arcuate extent of about 60° and we provide the access opening 41 with an arcuate extent of about 80° to accommodate this insertion. Each of the elements 39*a* has a radially outwardly extending flange as at 44 which flanks the steel annulus 38 as can be appreciated from a consideration of the showings in FIG. 4.

Also, each bearing element 39*a* is notched at the ends thereof for the receipt of a key 45—and for this purpose, the annulus 38 also has axially extending grooves therein—at six positions as illustrated (compare FIGS. 3 and 4). Thus, the inner bearing elements 39 constitute a total plastic bearing for the inner wall of the steel annulus 38. It will be appreciated however that depending upon the type of installation, the entire sheave may be plastic or metal, or arranged with different materials for the bearing and wear surfaces.

In the illustration given, the sidewalls of the annulus 38 are equipped with circular grooves as at 47 and 48—see the lower portion of FIG. 4. Grooves are spaced radially from each other and the inner groove 47 receives an oil seal 49 to confine the lubricant. Thus, oil dripping from the lubrication holes or ports 37 is confined in the area of the inner bearing elements 39.

The steel annulus 38 is a continuous piece and is installed prior to welding the second confining plate 27, 28 to the center pipe 26. It is machined with grooves on the sidewalls as at 47 and 48 for the oil seals 49 and for receipt of the legs of the outer journals 40.

Outer Plastic Wear Segments

In the illustration given, we make use of five of the outer wear elements 40. A different number can be used but with five, the arcuate extent of each is of the order of 72° and these can be readily inserted into the space between the confining plates 27 and 28 and snapped into the grooves 48—from either side and avoiding the shroud 50.

Each of the elements 40 is seen to have a circumferentially extending, centrally disposed recess as at 51—see FIG. 2—and this is generally in conformance with a similarily installed annular groove 52 provided in the annulus 38. Thus, should the elements 40 wear down, a rope way is provided on the annulus 38.

Extending radially inwardly of the element 40 are a plurality of lugs or detent means 53 which snap into place in the grooves 48 in the fashion seen in FIG. 4.

Operation

The central pipe 26 is welded in place to the two confining plates 27, 28 of the dump block 23. On the outside of the pipe 26 are provided two cover plates 32 and 33 welded as at 34 (see FIG. 4) over the open pipe ends. Alternatively, the side plates may be secured in other ways, as by bolted collars. Each cover plate has a pair of access openings 35 for oil fill and closed by an appropriate plug. The area formed inside the pipe 26 and the cover plates 32, 33 is now a large oil reservoir designated 54 in FIG. 4 with oil port means at 36.

Two port means 36 are provided in alignment with each of the access openings 35 and by comparing FIGS. 3 and 4, it will be seen that these are approximately 50° from the bottom of the dump block. As can be appreciated from FIG. 1, the dump block 23, when in operation, has its center line (running through the swivel lugs 30, 31) disposed about 40° to the horizontal. This means that the very bottom of the dump block is approximately 50° off of vertical. Inasmuch as it is not known just how the dump block will be oriented, we provide two sets of port means each approximately 50° offset from the very bottom of the dump block, i.e., the point opposite the swivel lugs 30, 31. Thus, the dump block becomes, in effect, reversible. Through the addition of the threaded fittings 37, the size of the port can be changed. For example, in colder weather, the viscosity of the oil increases so a larger port could be needed for proper lubrication. Also, through the provision of the threaded fittings 37 which project above the bottom of the reservoir (see FIG. 4), we keep the entrance of the axial opening above the bottom of the oil reservoir so that any dirt or scale will not clog the opening and stop oil from feeding to the bearing segments 39.

On the outside diameter of the pipe 26, which is machined, ride the plastic bearing inserts or segments 39. These are installed by way of the access opening 41—see FIG. 2. The access opening 41 is then covered by cover plate 42 with the associated screws 43 installed in place.

On the outside of the plastic bearing inserts 39 is a steel annulus 38. This ring is installed prior to the welding or other securing of the second of the two confining plates 27, 28 and is machined with side grooves for the oil seals 49 and the detent type lugs 53.

The rotating annulus 38 also has grooves cut laterally at six locations for the plastic keys 45 to be inserted. These plastic keys are fixed into the rotating ring and provide for the positive rotation of the plastic segments 39 so that they must travel around the pipe 26 with the annulus 38. This eliminates the possibility of all the wear on the plastic bearing being taken on a single one of elements 39 and, therefore, distributes the wear evenly. By the use of plastic keys, if the wear on the bearing inserts exceeds the height of the bearing above the key, the keys simply wear just like the rest of the plastic and no harm is done to the dump block. This extends the normal life of the bearings beyond that which could be expected with steel keys.

The hollow sheave including the members 38–40 is completed, in the illustration given, by installing the plastic wear elements 40. These are illustrated as being snapped in but other releasable lock means may be employed such as rotating the same sideways to a locked position. Both the annulus 38 and the wear elements 40 are contoured to provide a reeve-way for the rope. Little sliding movement occurs between the rope and the plastic elements 40. For example, there may be some relative sliding movement until the rotating ring gets up to speed with the rope but this normally is a very short period of time. It is expected that wear will occur on the plastic elements 40 and therefore we provide the annulus 38 with the same exterior contour so as to yield maximum wear and support for the rope if, in fact, the plastic is completely worn out.

The oil reservoir 54 provides for continuous lubrication to the plastic bearing segments 39 and with the oil seals 49 provide relatively maintenance-free operation with only cursory checking required. Instead of drip feed oil lubrication, a forced feed can be employed by use of a spring-loaded molygreaser.

As mentioned previously, the other main concern for the traditional dump block (besides the high maintenance of the tapered roller bearings) is the life of the dump rope itself. The life of the dump rope depends upon the diameter of the rope, the diameter of the sheave or dump block, the flexibility of the dump rope and the material which the rope contacts—namely the sheave groove.

Inasmuch as the rigging should be as light as possible to minimize weight, the diameter of the dump block and therefore the diameter of the sheave is likewise limited. A minimum diameter reduces the expected life of the dump rope by bending fatigue and internal fatigue. This coupled with the abrasion aspect of a manganese or other steel sheave on the softer wire rope wears the dump rope out very quickly. It has been shown in several instances that a material such as plastic, when used as a dump block sheave, will double or triple the life of the dump rope, all other factors being equal. However, a plastic of high strength and rigidity suitable for use in the extreme loads incurred by a dump block is very expensive. Therefore, a sheave of this magnitude which must be changed quite often becomes a prohibitive expense. According to the instant invention, we do not have to replace the entire sheave when the rope groove is worn beyond use but simply replace only the rope groove segments. Making these rope grooves quick to change and smaller, reduces the down-time, down-time cost, and also, the cost of the plastic pieces.

As indicated, the rope groove wear or segments 40 are snapped or otherwise temporarily locked into place over the rotating annulus 38. The lugs or detent means on the radial inside of the rope groove elements 40, when forced into the steel annulus, simply bend outwardly and then snap into the groove 48. Since there is no force trying to tear the rope groove segments or elements 40 off of the annulus 38 (with the exception of centrifugal force), the force required to hold the rope groove segments on is minimal. The majority of the force is a compressive force applied by the rope during operation. When the rope groove elements 40 are worn by the rope—and usually this is after four to five rope changes—the plastic rope groove elements 40 are removed from the rotating ring and new rope groove segments snapped into place. To accomplish this, it is not necessary to remove the rope from the dump block. However, the normal operation is to change these segments at a rope change.

Testing thus far has revealed that different materials of construction are required for the bearing segments 39 as contrasted to the rope groove elements 40. This is because different forces and different conditions exist. However, a generous range of materials can be applied since testing, under as close to field conditions as could be attained, show that a useful life of 0.5" wear on the bearing segments 39 would last as long as several years before they would have to be changed. This is a vast improvement over the present tapered roller bearing system and during the entire testing, the only maintenance required is to periodically fill the oil reservoir so that the bearing segments 39 never run dry. Some oil loss through imperfect seals at 49 can be tolerated because the oil reservoir 54 is large enough in the illustration given for approximately nineteen gallons.

It will also be appreciated that more than one dump block can be installed in a series. For example, several sheaves in a row are employed in clamshell operation or even in a point sheave operation on the large dragline bucket, the center pin or shaft can carry more than one sheave which could rotate independently.

While in the foregoing specification a detailed description of an embodiment of the invention has been set down for the purpose of illustration, many variations in the details hereingiven may be made by those skilled in the art without departing from the spirit and scope of the invention.

We claim:

1. A dump block for a dragline bucket comprising a body having a central cylinder and auxiliary-spaced rope confining walls defining a reeveway for a dump rope, a ring rotatably mounted on said cylinder and having a replaceable plastic outer surface adapted to engage said rope and a replaceable plastic inner surface arranged to engage said cylinder, said cylinder being equipped with means for lubricating said ring inner surface, said inner and outer surfaces each including a plurality of arcuately related, removable plastic segments, at least one of said walls being equipped with access means for inner surface segment removal.

2. The structure of claim 1 in which said cylinder is equipped with lubricant orifice means.

3. A dump block for a dragline bucket comprising a hollow cylinder having a machined outer surface, a pair of confining plates secured in axially spaced relation to said outer surface, at least one composite sheave mounted on said cylinder between said confining plates and including a steel annulus having inner segmental plastic bearings and outer groove-providing plastic segments, means in said confining plates for replacing said inner segments and closure and port means operably associated with said cylinder for providing lubricant to said inner segments.

4. The structure of claim 3 in which said annulus has a grooved radially outer surface and grooved segments releasably locked to said annulus outer surface.

5. A dump block for a dragline bucket comprising a body having a central cylinder and axially-spaced rope confining walls defining a reeveway and a dump rope, a bearing rotatably mounted on said cylinder and including a steel annulus equipped with segmental inner plastic bearing elements and outer plastic arcuate rope support elements both removably secured thereto, and access means in said confining walls for replacing said inner plastic elements, said cylinder also constituting a lubricant reservoir and being equipped with closure and port means for lubricating said bearing elements.

6. A dump block for a dragline bucket comprising a body having a central cylinder and axially-spaced rope confining walls defining a reeve-way for a dump rope, a bearing rotatably mounted on said cylinder and including a steel annulus equipped with segmental inner plastic bearing elements and outer plastic arcuate rope support elements removably secured thereto, and access means in said confining walls for replacing said inner plastic elements, said cylinder also constituting a lubricant reservoir and being equipped with closure and port means for lubricating said bearing elements, said access means including an arcuate opening in each confining wall, said opening being sized to pass one of said inner elements, and cover means for each opening removably secured to each confining wall.

7. The structure of claim 6 in which said inner elements are releasably locked to said steel annulus.

8. The structure of claim 6 in which said steel annulus is equipped with seal means to confine flow of said lubricant substantially to said inner bearing elements.

9. A dump block for a dragline bucket comprising a body having a central cylinder and axially-spaced rope confining walls defining a reeve-way for a dump rope, a bearing rotatably mounted on said cylinder and including a steel annulus equipped with segmental inner plastic bearing elements and outer plastic arcuate rope support elements removably secured thereto, and access means in said confining walls for replacing said inner plastic elements, said cylinder also constituting a lubricant reservoir and being equipped with closure and port means for lubricating said bearing elements, said steel annulus inner and outer arcuate walls disposed concentric to the axis of said cylinder and flanked by radially extending sidewalls, each annulus sidewall being equipped with groove means for releasably mounting said outer elements.

10. The structure of claim 9 in which said annulus sidewalls are equipped with radially spaced grooves, the inner of said grooves being equipped with seal means for said lubricant and the outer of said grooves constituting said means for releasably mounting said outer elements.

11. The structure of claim 9 in which each outer element is equipped with radially inwardly extending detent means for engaging said groove means.

12. The structure of claim 9 in which each of said outer bearing elements are centrally circumferentially recessed to provide a rope way.

13. The structure of claim 12 in which said annulus outer arcuate wall is contoured similar to said outer bearing elements.

14. The structure of claim 5 in which said cylinder is a seamless pipe.

15. The structure of claim 5 in which said confining walls are extended in aligned portions thereof to provide a swivel mount, said cylinder port means being angularly spaced from said swivel mount.

16. The structure of claim 15 in which said cylinder closure means includes plate means weldably secured to the cylinder ends and having openable ports means for filling said cylinder with lubricant.

17. The structure of claim 5 in which each inner bearing element has an arcuate extent of about 60°.

18. The structure of claim 17 in which said access opening has an arcuate extent of about 80°.

19. The structure of claim 5 in which five outer elements are mounted on said annulus.

20. The structure of claim 5 in which said body has a swivel mount at one end, said port means being provided adjacent to but spaced from the other body end.

21. The structure of claim 20 in which said port means are spaced equally on opposite sides of said other body end.

* * * * *